US007695327B2

(12) United States Patent
Bäuerle et al.

(10) Patent No.: US 7,695,327 B2
(45) Date of Patent: Apr. 13, 2010

(54) CONTACT ELEMENT

(75) Inventors: Klaus Bäuerle, Tengen (DE); Frank Walter, Blumberg (DE); Hermann Stadler, Donaueschingen (DE)

(73) Assignee: MC Technology GmbH, Blumberg (DE)

( * ) Notice: Subject to any disclaimer, the term of this patent is extended or adjusted under 35 U.S.C. 154(b) by 0 days.

(21) Appl. No.: 12/010,314

(22) Filed: Jan. 23, 2008

(65) Prior Publication Data

US 2008/0261463 A1 Oct. 23, 2008

(30) Foreign Application Priority Data

Jan. 24, 2007 (DE) ..... 10 2007 004 547

(51) Int. Cl.
*H01R 4/36* (2006.01)

(52) U.S. Cl. ..... 439/811; 439/940

(58) Field of Classification Search ..... 439/135, 439/811, 885, 940

See application file for complete search history.

(56) References Cited

U.S. PATENT DOCUMENTS 4,964,813 A * 10/1990 Francois et al. ..... 439/811
6,475,038 B1 * 11/2002 Franck ..... 439/811
2005/0042933 A1 2/2005 Cisey

FOREIGN PATENT DOCUMENTS

| | | |
|---|---|---|
| DE | 24 16 231 C3 | 10/1975 |
| DE | 24 02 087 B2 | 7/1978 |
| DE | 83 23 687.2 U1 | 12/1983 |
| DE | 35 15 564 A1 | 10/1986 |
| DE | 92 17 684.4 U1 | 4/1993 |
| DE | 198 44 461 A1 | 3/2000 |

* cited by examiner

*Primary Examiner*—Khiem Nguyen
(74) *Attorney, Agent, or Firm*—The Nath Law Group; Jerald L. Meyer; Derek Richmond

(57) ABSTRACT

The invention relates to a contact element for printed circuit boards, comprising a terminal body that has an insertion opening for the insertion of a conductor and a screw for the fastening by clamping of the conductor within the terminal body. A seating element with a seating surface is detachably fastenable by a fastening element to the contact element. The seating surface has a surface area that is greater than the cross-sectional surface area of the terminal body.

20 Claims, 4 Drawing Sheets

CONTACT ELEMENT

The invention relates to a contact element for printed circuit board terminals.

Contact elements for printed circuit board terminals are well known that have a terminal body in which an insertion opening is disposed for the insertion of a conductor and a screw is disposed for the fastening by clamping of a conductor within the terminal body. Whenever these contact elements are transported, there is a problem in that the screw within terminal body is not secured and can become detached during transport, with the resulting danger of losing the screw.

In addition, these contact elements are inserted by hand since the shape of the single terminal with its upwardly protruding screw is very unwieldy, thereby necessitating very expensive specialized machines for automated processing.

The problem to be solved by the invention thus consists in further developing a contact element for printed circuit board terminals so as to provide a securing means for the screw and so as to simplify the contact element.

The problem is solved according to the invention by a seating element for a contact element for printed circuit board terminals comprising the features of claim 1, and by a contact element comprising the features of claim 9.

Advantageous embodiments and developments of the invention are described in the subordinate claims.

According to the invention, a seating element for detachable fastening to the contact element is provided. The seating element has a seating surface and a fastening element for detachable fastening to the contact element. After fabrication of the contact element, the detachable fastening enables the seating element first to be fastened to the contact element and then to be transported. Once the contact element has arrived at a position at which it is to be processed, the seating element can be detached. The seating surface of the seating element here is greater than the cross-sectional area of the terminal body so as to provide a sufficiently large engagement surface for automation devices, in particular, vacuum grippers or the like, with the result that the contact elements can be moved using conventional automation devices.

It has proven especially advantageous to design the seating surface in a flat and uninterrupted fashion. A seating surface designed in this way is ideal for vacuum grippers since it facilitates generation of the vacuum required for the gripping process as a closed nonporous seating surface does not allow any air to leak in, while a flat surface facilitates the application of the vacuum gripper's seal.

In an especially advantageous embodiment of the invention, the fastening element of the seating element is suitable for detachable fastening to the screw head of the screw of the contact element. The contact elements are generally designed such that the contacts which must be disposed on the printed circuit board are disposed on one side of the terminal body, while the screw on the side of the terminal body opposite the contacts protrudes from the terminal body. When the fastening element is fastened to the screw head, the contact elements can be gripped from above, and in particular disposed with the aid of the seating element on the corresponding positions of the circuit board, with the result that during the entire transport and handling process for the contact element the seating element can be disposed on the contact element, then removed only after correct positioning. In addition, the seating element provides loss protection for the screw.

The fastening element preferably has a detent element, clamping element, and/or element achieving positive engagement so that the fastening element can be used to dispose the seating element on the contact element in the simplest possible but also reliable manner.

In an especially preferable approach, the fastening element is designed as a ring, or at least one, preferably two, ring segments that can be placed in particular around the screw head in the screw of the contact element. This ensures that the screw is seated within the fastening element in an essentially rotationally-locked manner.

In an especially preferred embodiment of the invention, a lateral wing is disposed on the seating element so that the wing sits on the contact element when the contact element is in the fastened state so as to form an rotational locking means. This ensures that the screw cannot fall out of the terminal body when the contact element is transported, and in particular that the screw is prevented from rotating as long as it is disposed in the seating element in a rotationally-locked manner.

Preferably, two lateral wings are disposed on the seating element so that in the state when the seating element is fastened to the contact element these wings rest against the contact element such that the contact element is detachably clamped. As a result, the lateral wings can provide both the rotational locking means as well as simultaneously taking on the function of the fastening element. In particular, appropriately designed fastening elements can preferably simultaneously also perform the function of rotational locking.

Preferably, the seating surface is of an essentially rectangular form and has a recess at one corner. The function of this recess is to enable the seating elements in a conveyor belt of a pick-and-place machine, or other automation device, to always be oriented in the same direction.

The contact element according to the invention for printed circuit board terminals has a seating element according to the invention. This enables the contact element to be manipulated in automation devices since these are able to engage by the seating surface of the contact element. This also ensures that the screw cannot unscrew from the terminal body accidentally.

Preferably, the terminal body has a wire guard that prevents the screw from damaging the conductor inserted into the terminal body.

Preferably, at least one solder pin or an SMD surface (SMD=surface mounted device) can be disposed on the terminal body to enable the contact element to be fastened to a circuit board.

What is preferred in particular is to design the contact element as a single terminal since it is specifically for such contact elements that the requirement exists to be able to easily manipulate these single parts.

The invention is described in detail based on the following figures. In the figures.

Figure 1:
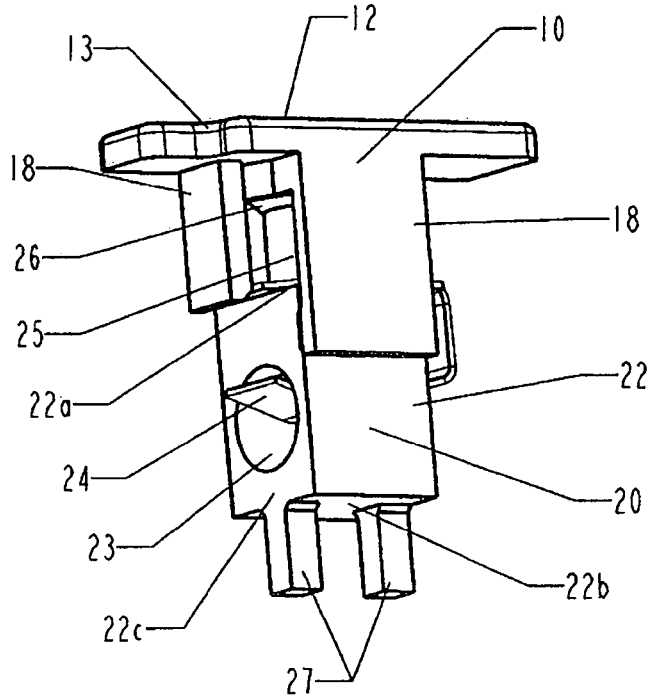
FIG. 1 is a perspective view of a first embodiment of the invention.
Figure 2:
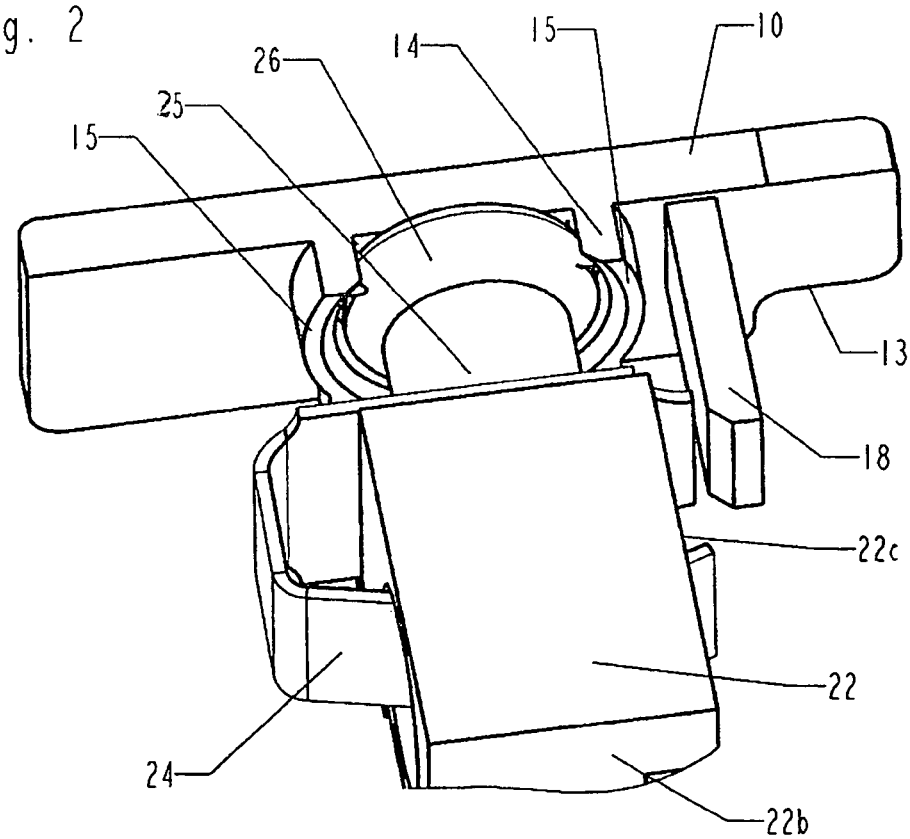
FIG. 2 is another perspective view of the embodiment of FIG. 1.

FIGS. 1 and 2 provide two perspective views of a first embodiment of the invention, wherein a seating element 10 is detachably fastened to a contact element 20. Contact element 20 has a terminal body 22 comprising a top side 22*a*, a bottom side 22*b*, and a front side 22*c*. Terminal body 22 here is essentially of a cuboid shape. Disposed in front side 22*c* is an insertion opening 23 through which an electrical conductor, not shown, can be inserted into terminal body 22. A screw 25 is screwed into terminal body 22 from top side 22*a* of terminal body 22, by which screw the electrical conductor inserted through insertion opening 23 into terminal body 22 can be clamped in place within terminal body 22. Screw 25 here normally has a screw head 26.

Disposed on bottom side 22*b* of terminal body 22 are two solder pins 27 with the aid of which contact element 20 can be connected electrically conductively on a circuit board.

Disposed in terminal body 22 is a wire guard 24 that extends from top side 22*a* of terminal body 22 through insertion opening 23 into terminal body 22, and thus ultimately rests between screw 25 and the conductor inserted through insertion opening 23 into terminal body 22, thereby preventing the conductor from being damaged when screw 25 is screwed in.

Seating element 10 disposed on contact element 20 has an essentially rectangular seating surface 12 that has a recess 13 at one corner. Seating surface 12 is uninterrupted, in other words, has no holes within the boundary of the surface. In addition, seating surface 12 is of a flat design. Seating surface 12 has a surface area that is greater than the cross-sectional surface area through terminal body 22, wherein the cross-sectional surface is produced as the surface of a section perpendicular to the longitudinal axis of screw 25 outside of the region of insertion opening 23, in particular, as the surface of top side 22*a* or bottom side 22*b*. As a result, seating surface 12 essentially covers contact element 20 completely as viewed from the top. In particular, the surface area of seating surface 12 is greater than the projected base of terminal body 22 of contact element 20. This ensures that an automation device with, for example, a vacuum gripper can engage, and contact element 20 can thus be easily manipulated in an automation device.

Seating element 10 is detachably fastened by a fastening element 14 to contact element 20, wherein the attachment should be sufficiently strong that contact element 20 that is hanging downward should not be able to detach due to its own weight even when only seating element 10 is gripped by an automation device. In the present case, fastening element 14 has two ring segments 15 that by positive engagement encompass screw head 26 of screw 25, or that snap onto screw head 26 of screw 25. What must be ensured here is that screw head 26 is not able to rotate easily within fastening element 14.

On seating element 10, a lateral wing 18 is disposed in vertical fashion, in particular, essentially perpendicular on seating surface 12, wherein the wing is disposed on the same side of seating surface 12 as fastening element 14, and thus in the state of seating element 10 being attached to contact element 20 points toward contact element 20. Lateral wing 18 here is designed such that in the state of seating element 10 being mounted on contact element 20 the wing rests against contact element 20 so that seating element 10 cannot be rotated against contact element 20, for example, about the longitudinal axis of screw 25. For example, to this end lateral wing 18 directly rests on a lateral surface of terminal body 22. In particular, it is also possible for more than one lateral wing 18 to be disposed on seating element 10. The use of seating element 10 thus first of all insures that screw 25 is disposed on contact element 20 is a loss-protected manner. Secondly, screw 25 also can no longer be rotated within terminal body 22, with the result that it can neither be screwed into or out of terminal body 22, and thus after assembly of contact element 20 allows the corresponding conductor to be connected without further manipulation directly to contact element 20.

Figure 3:
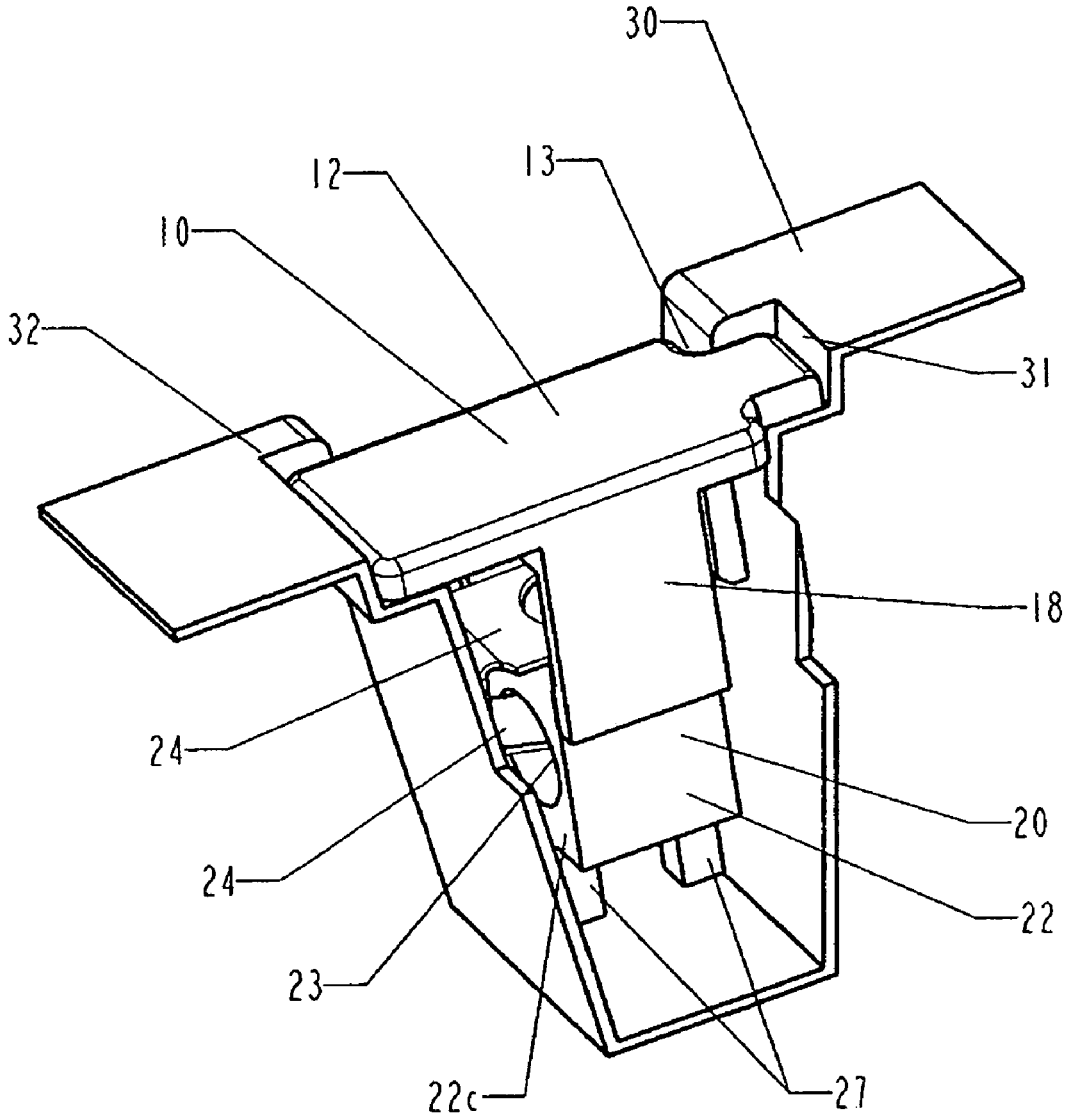
FIG. 3 is a perspective view of a configuration of the embodiment of FIG. 1 in a conveyor belt of an automation device.

In FIG. 3, the embodiment composed of contact element 20 and seating element 10 of FIG. 1 is illustrated when inserted in a conveyor belt 30 of an automation device, for example, a pick-and-place machine. Conveyor belt 30 has an essentially U-shaped design so that contact element 20 can be lowered from above into conveyor belt 30 and engages recesses 31, 32 of the conveyor belt by the short sides of the essentially rectangular seating surface 12 of contact element 10. Recess 31 here is somewhat narrower than recess 32 such that seating element 10, which in seating surface 12 has recess 13 only on one side, can be inserted in a unique orientation into conveyor belt 30. This approach ensures that contact elements 20 are all transported in the same orientation within conveyor belt 30.

Figure 4:
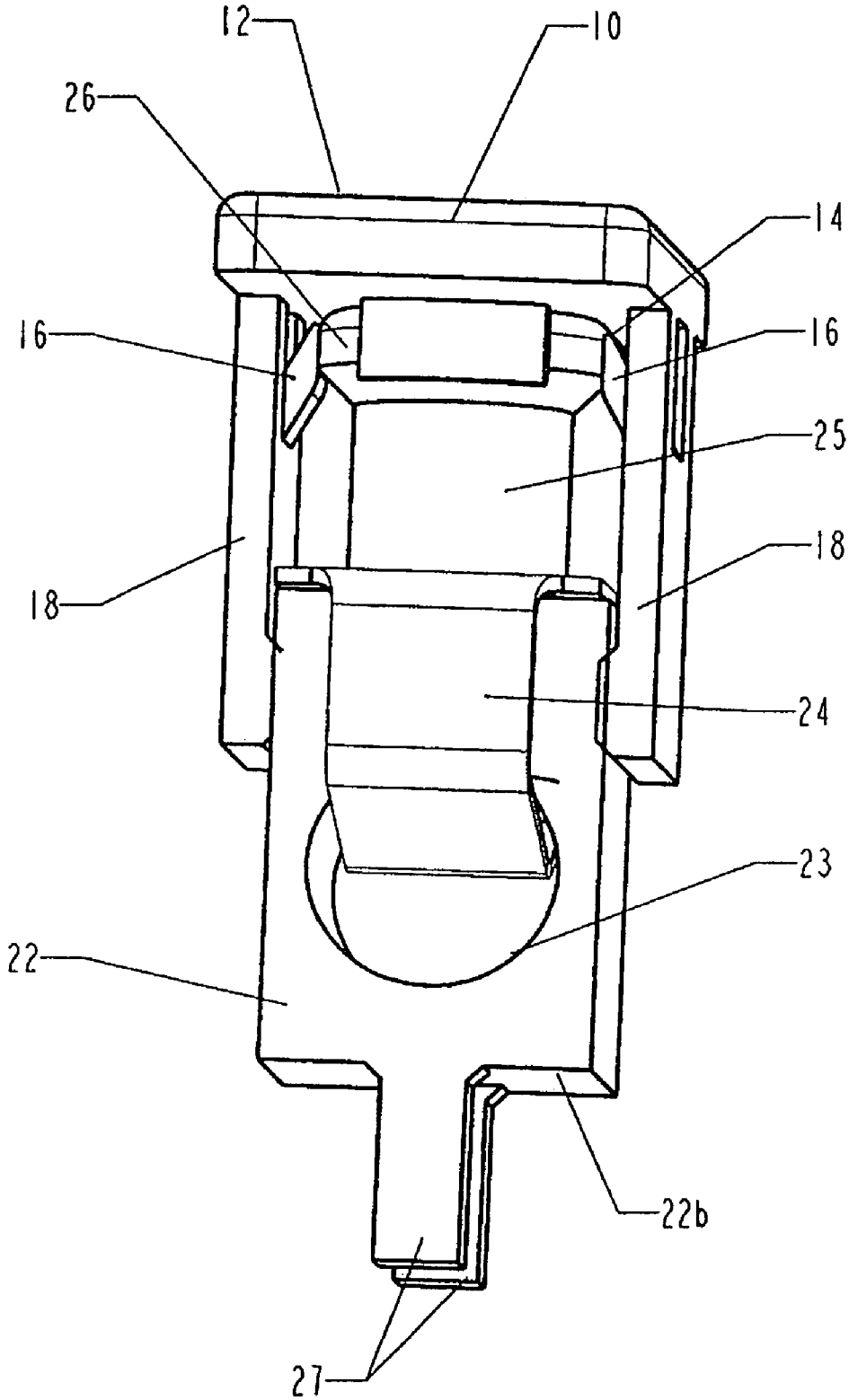
FIG. 4 is a perspective view of a second embodiment of the invention.

FIG. 4 illustrates another embodiment of the invention. Contact element 20 is essentially identical to contact element 20 of the first embodiment, identical parts being designated by identical reference numbers. Seating element 10 also essentially corresponds to seating element 10 of the first embodiment so that identical parts are designated by identical reference numbers. Seating element 10 of the second embodiment differs from seating element 10 of the first embodiment in the design of fastening element 14. In this case, this fastening element 14 is composed of multiple spring elements 16 that rest against the outer periphery of screw head 26 of screw 25.

Figure 5:
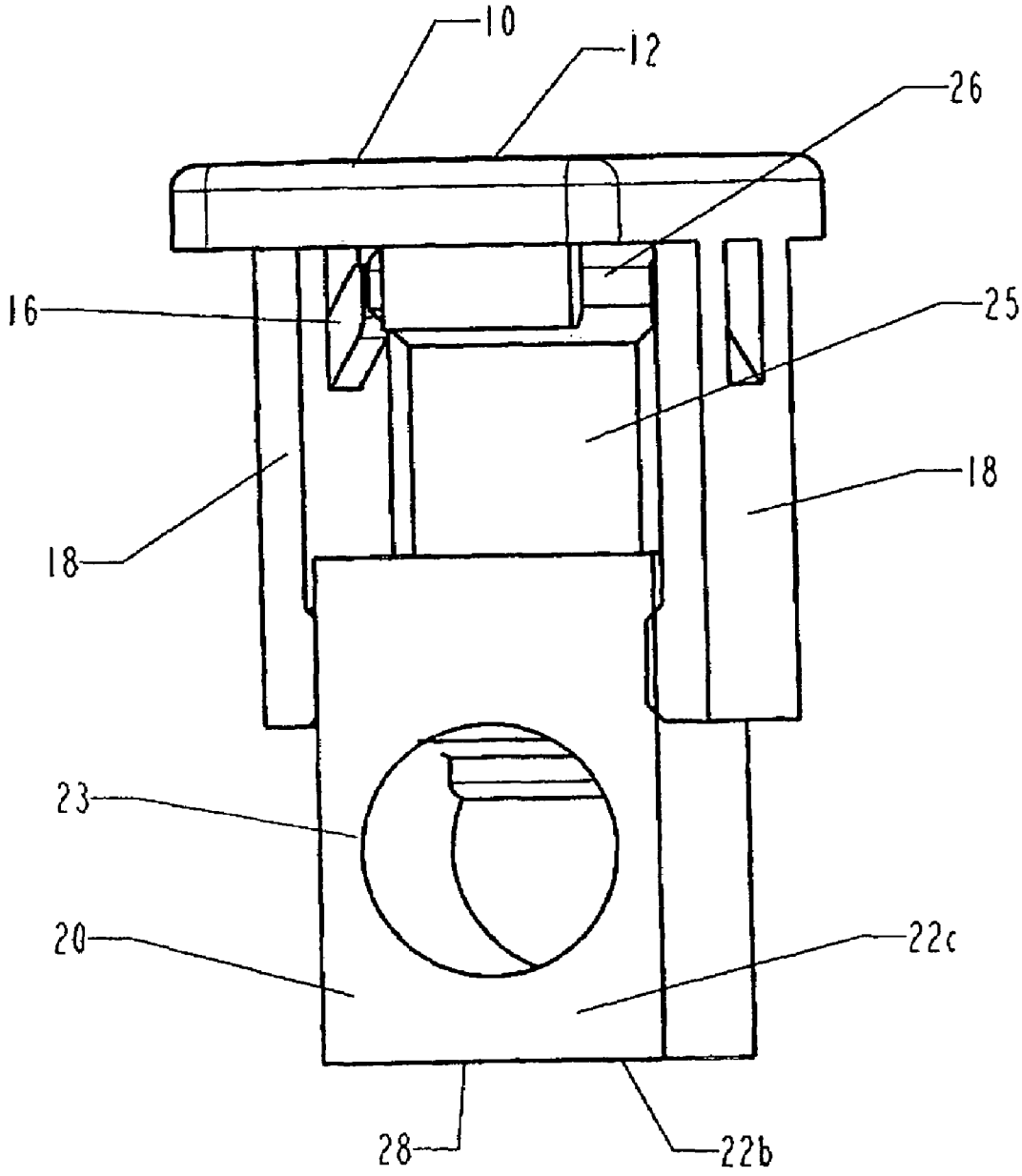
FIG. 5 is a perspective view of a third embodiment of the invention.

Finally, FIG. 5 shows a third embodiment of the invention, wherein seating element 10 essentially corresponds to seating element 10 of the second embodiment of FIG. 4. Contact element 20 essentially corresponds to contact element 20 of the second embodiment in FIG. 4, identical parts being designated by identical reference numbers. Contact element 20 of the third embodiment differs from contact element 20 of the first and second embodiments in that no solder pins 27 are disposed on bottom side 22*b*, but instead bottom side 22*b* is designed as an SMD surface 28.

LIST OF REFERENCE NOTATIONS

10 seating element
12 seating surface
13 recess
14 fastening element
15 ring segment
16 spring element
18 lateral wing
20 contact element
22 terminal body
22*a* top side
22*b* bottom side
23 insertion opening
24 wire guard
25 screw
26 screw head
27 solder pin
28 SMD surface
30 conveyor belt
31 recess
32 recess

The invention claimed is:

1. Seating element comprising:

a seating surface and a fastening element for the detachable fastening of the seating element to a contact element for printed circuit boards having a terminal body that has an insertion opening for the insertion of a conductor and a screw for the fastening by clamping of the conductor within the terminal body, wherein the seating surface has a flat and uninterrupted surface greater than the cross-sectional surface area of the terminal body.

2. Seating element according to claim 1, characterized in that the seating surface has a seating surface greater than a projected base of the terminal body, thereby facilitating engagement by a vacuum gripper for manipulation in an automation device.

3. Seating element according to claim 1, characterized in that the fastening element is suitable for the detachable fastening of the seating element to the screw head of the screw of the contact element.

4. Seating element according to claim 1, characterized in that the fastening element is a detent element, a clamping element, and/or an element achieving a positive engagement.

5. Seating element according to claim 1, characterized in that the fastening element is designed as a ring having at least one ring segment.

6. Seating element according to claim 1, characterized in that a lateral wing is disposed on the seating element such that in the state when fastened to the contact element the wing rests against the contact element so that it forms a rotational locking means.

7. Seating element according to claim 1, characterized in that two lateral wings are disposed on the seating element such that in the state when fastened to the contact element these rest against contact element so that the contact element is detachably clamped.

8. Seating element according to claim 1, characterized in that the seating surface is of an essentially rectangular design and has a recess at one corner.

9. Contact element for printed circuit board terminals comprising:

a terminal body that has an insertion opening for the insertion of a conductor and a screw for the fastening by clamping of the conductor within the terminal body; and a seating element detachably fastened to the contact element, the seating element comprising a seating surface and a fastening element for the detachable fastening of the seating element to one of the screw and the terminal body; and a seating surface on the seating element, wherein the seating surface has a flat and uninterrupted surface greater than the cross-sectional surface area of the terminal body.

10. Contact element according to claim 9, characterized in that a wire guard is disposed on the terminal body.

11. Contact element according to claim 9, characterized in that at least one solder pin or an SMD (surface mounted device) surface is disposed on the terminal body.

12. Contact element according to claim 9, characterized in that the contact element is designed as a single terminal.

13. Seating element according to claim 1, characterized in that the fastening element is designed as a ring having two ring segments.

14. Contact element according to claim 9, characterized in that the seating surface has a seating surface greater than a projected base of the terminal body, thereby facilitating engagement by a vacuum gripper for manipulation in an automation device.

15. Seating element according to claim 1, wherein the seating element has two ring segments that, by positive engagement encompass the screw head of the screw, or that snap onto the screw head of the screw, thereby preventing the screw head from rotating easily within the terminal body.

16. Seating element according to claim 1, wherein the seating element secures the screw in association with the terminal body in a loss-protected manner and engages the head of the screw, thereby preventing the screw head from rotating easily within the terminal body.

17. Seating element according to claim 1, wherein the seating element secures the screw in association with the terminal body in a loss-protected manner and engages the head of the screw, thereby preventing the screw head from rotating easily within the terminal body.

18. Contact element according to claim 9, wherein the seating element has two ring segments that by positive engagement encompass the screw head of the screw, or that snap onto the screw head of the screw, thereby preventing the screw head from rotating easily within the terminal body.

19. Contact element according to claim 9, wherein the seating element secures the screw in association with the terminal body in a loss-protected manner and engages the head of the screw, thereby preventing the screw head from rotating easily within the terminal body.

20. Contact element according to claim 9, wherein the seating element secures the screw in association with the terminal body in a loss-protected manner and engages the head of the screw, thereby preventing the screw head from rotating easily within the terminal body.

* * * * *